US010047963B2

(12) United States Patent
Ugajin et al.

(10) Patent No.: US 10,047,963 B2
(45) Date of Patent: Aug. 14, 2018

(54) INDOOR UNIT FOR AIR-CONDITIONING APPARATUS

(71) Applicant: Mitsubishi Electric Corporation, Tokyo (JP)

(72) Inventors: Yuki Ugajin, Tokyo (JP); Hideaki Maeyama, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 2 days.

(21) Appl. No.: 15/510,898

(22) PCT Filed: Nov. 4, 2014

(86) PCT No.: PCT/JP2014/079182

§ 371 (c)(1),
(2) Date: Mar. 13, 2017

(87) PCT Pub. No.: WO2016/071945

PCT Pub. Date: May 12, 2016

(65) Prior Publication Data

US 2017/0284682 A1 Oct. 5, 2017

(51) Int. Cl.

| | |
|---|---|
| ***F24D 19/02*** | (2006.01) |
| ***F24F 1/00*** | (2011.01) |
| ***F24F 13/20*** | (2006.01) |

(52) U.S. Cl.

CPC ..... *F24F 1/0059* (2013.01); *F24F 1/0025* (2013.01); *F24F 13/20* (2013.01); *F24F 2001/0048* (2013.01)

(58) Field of Classification Search

CPC ..... F24F 1/0059; F24F 1/0025; F24F 13/20; F24F 2001/0048; H05K 7/20781;

(Continued)

(56) References Cited

U.S. PATENT DOCUMENTS

| | | | | |
|---|---|---|---|---|
| 2011/0030420 | A1* | 2/2011 | Kirkwood | F25B 39/00 62/498 |
| 2013/0091891 | A1* | 4/2013 | Hinde | F25B 43/02 62/470 |
| 2014/0285965 | A1* | 9/2014 | Keisling | H05K 7/20609 361/679.53 |

FOREIGN PATENT DOCUMENTS

| | | |
|---|---|---|
| JP | 51-145659 U | 11/1976 |
| JP | 63-003191 A | 1/1988 |

(Continued)

OTHER PUBLICATIONS

Office Action dated Dec. 5, 2017 issued in corresponding JP patent application No. 2016-557362 (and English translation).

(Continued)

*Primary Examiner* — Davis Hwu
(74) *Attorney, Agent, or Firm* — Posz Law Group, PLC

(57) ABSTRACT

An indoor unit for an air-conditioning apparatus includes a case, an air-sending fan, and a heat exchanger unit. The heat exchanger unit includes a plurality of heat-transfer pipes extending in a vertical direction and forming a plurality of refrigerant passages in a width direction of the case and an air flow direction, and a plurality of headers connected to both ends of the plurality of heat-transfer pipes to allow the refrigerant to flow between the plurality of heat-transfer pipes. The plurality of headers include a plurality of division headers dividing and connecting the plurality of heat-transfer pipes arranged in the air flow direction and connecting in parallel the plurality of heat-transfer pipes arranged in the width direction, and a return header connecting and turning back the plurality of divided refrigerant passages arranged in the air flow direction and connecting in parallel the plurality of heat-transfer pipes arranged in the width direction.

6 Claims, 4 Drawing Sheets

(58) Field of Classification Search
CPC .. H05K 7/20609; H05K 7/2079; F25B 43/02; F25B 39/00
USPC ..... 165/55
See application file for complete search history.

(56) References Cited

FOREIGN PATENT DOCUMENTS

| | | | |
|---|---|---|---|
| JP | 04-187990 | A | 7/1992 |
| JP | 2002-206890 | A | 7/2002 |
| JP | 2002-372383 | A | 12/2002 |
| JP | 2003-214724 | A | 7/2003 |
| JP | 2007-147144 | A | 6/2007 |
| JP | 2008-256305 | A | 10/2008 |
| JP | 2010-025456 | A | 2/2010 |
| JP | 2010-107103 | A | 5/2010 |

OTHER PUBLICATIONS

International Search Report of the International Searching Authority dated Feb. 10, 2015 for the corresponding international application No. PCT/JP2014/079182 (and English translation).

* cited by examiner

INDOOR UNIT FOR AIR-CONDITIONING APPARATUS

CROSS REFERENCE TO RELATED APPLICATION

This application is a U.S. national stage application of PCT/JP2014/079182 filed on Nov. 4, 2014, the contents of which are incorporated herein by reference.

TECHNICAL FIELD

The present invention relates to an indoor unit for an air-conditioning apparatus including a heat exchanger in which a heat-transfer pipe extends in the vertical direction.

BACKGROUND ART

An indoor unit equipped with a parallel flow type heat exchanger as a heat exchanger of an indoor unit has been known (see, for example, Patent Literature 1). Patent Literature 1 discloses an indoor unit including a heat exchanger in which a plurality of heat-transfer pipes and fins extending in the vertical direction are stacked alternately, and a liquid-side header and a gas-side header extending in the horizontal direction are connected to both ends of the heat-transfer pipes. During cooling operation, refrigerant is distributed to the plurality of heat-transfer pipes at the liquid-side header and flows from the plurality of heat-transfer pipes into the gas-side header. On the other hand, during heating operation, the refrigerant is distributed to the plurality of heat-transfer pipes at the gas-side header and flows from the plurality of heat-transfer pipes into the liquid-side header.

CITATION LIST

Patent Literature

Patent Literature 1: Japanese Unexamined Patent Application Publication No. 2008-256305 (FIG. 8, FIG. 9)

SUMMARY OF INVENTION

Technical Problem

As described above, in the heat exchanger of Patent Literature 1, the headers extend in the horizontal direction, so that the heat exchanger is structured to inhibit the refrigerant from being unevenly distributed to the plurality of heat-transfer pipes due to influence of the gravity. However, as a refrigerant passage is formed to allow the refrigerant to flow from one of the headers, pass through the plurality of heat-transfer pipes, and flow out from the other header, the heat transfer area of the heat exchanger cannot be increased, and thus air-conditioning performance is difficult to be improved.

The present invention has been made to solve the above-described problem, and an object of the present invention is to provide an indoor unit for an air-conditioning apparatus having an increased heat transfer area to improve air-conditioning performance.

Solution to Problem

An indoor unit for an air-conditioning apparatus according to an embodiment of the present invention includes a case, an air-sending fan accommodated in the case, and a heat exchanger unit provided to cover the air-sending fan and configured to exchange heat between refrigerant and air. The heat exchanger unit includes a plurality of heat-transfer pipes extending in a vertical direction and forming a plurality of refrigerant passages in an air flow direction and a width direction of the case, and a plurality of headers connected to both ends of the plurality of heat-transfer pipes to allow the refrigerant to flow between the plurality of heat-transfer pipes. The plurality of headers include a plurality of division headers dividing and connecting the plurality of refrigerant passages arranged in the air flow direction and connecting in parallel the plurality of refrigerant passages arranged in the width direction of the case, and a return header connecting and turning back the plurality of refrigerant passages arranged in the air flow direction divided in the plurality of division headers and connecting in parallel the plurality of heat-transfer pipes arranged in the width direction of the case.

Advantageous Effects of Invention

In the indoor unit for an air-conditioning apparatus according to the embodiment of the present invention, as the plurality of heat-transfer pipes are arranged in the air flow direction of the case and different refrigerant passages are formed in the heat exchanger unit in the air flow direction using the division headers and the return header, the heat transfer area of the heat exchanger unit can be increased to improve an air-conditioning capacity even in the case where the heat-transfer pipes extending in the vertical direction are used.

DESCRIPTION OF EMBODIMENTS

Embodiment 1

Figure 1:
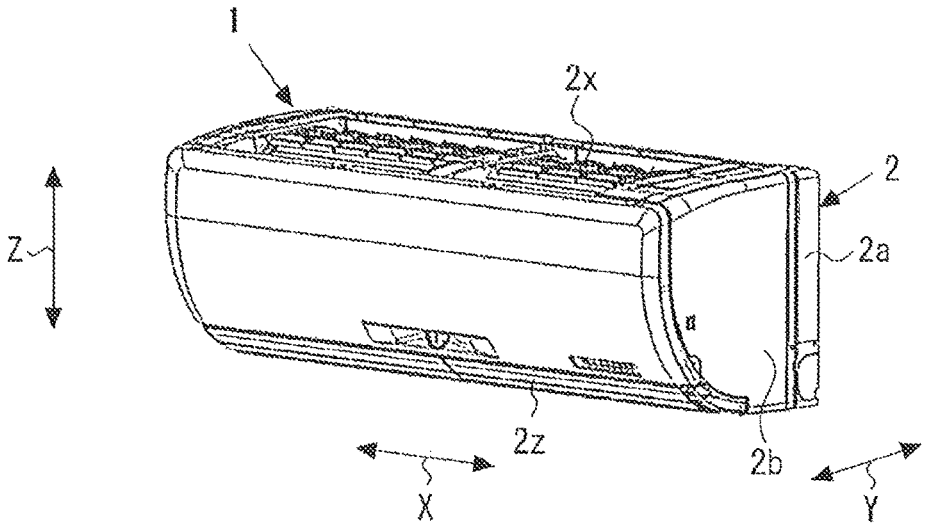
FIG. 1 is a perspective view showing an indoor unit for an air-conditioning apparatus according to Embodiment 1 of the present invention.
Figure 2:
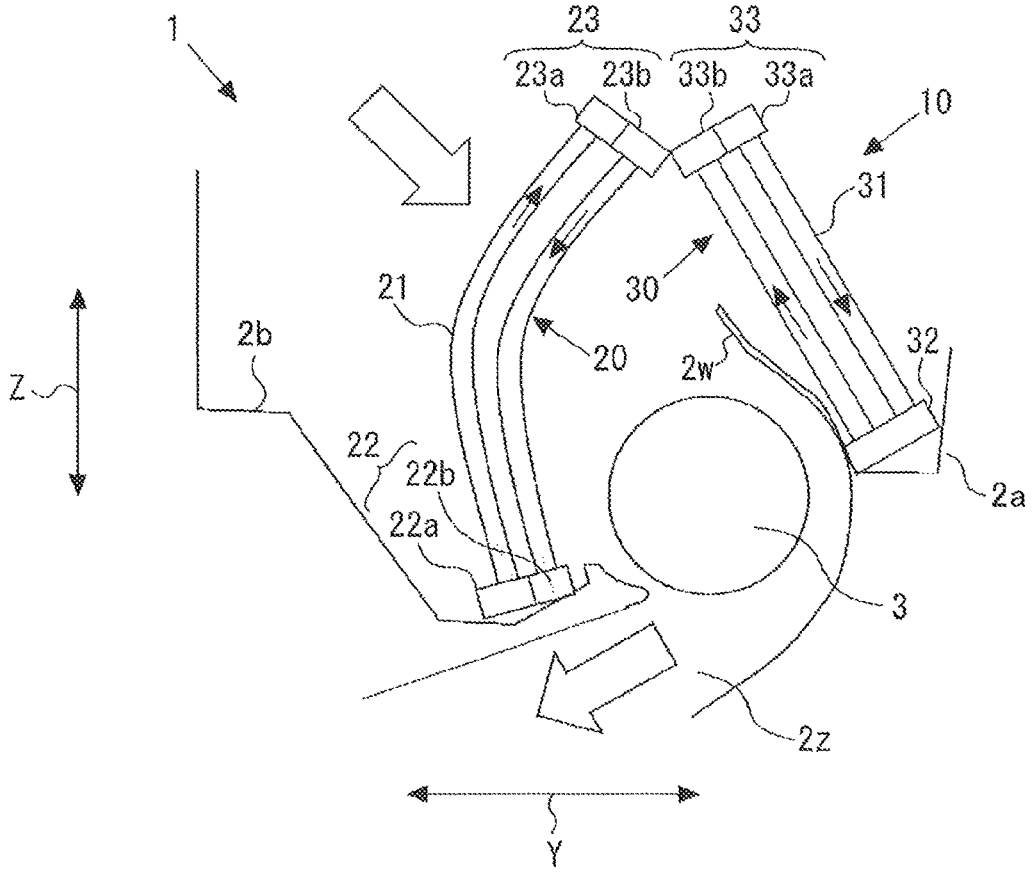
FIG. 2 is a cross-sectional view showing the indoor unit for an air-conditioning apparatus according to Embodiment 1 of the present invention.

Hereinafter, preferred embodiments of the indoor unit for an air-conditioning apparatus of the present invention are described with reference to the drawings. FIG. 1 is a perspective view showing the indoor unit for an air-conditioning apparatus according to Embodiment 1 of the present invention, and FIG. 2 is a cross-sectional view showing the indoor unit for an air-conditioning apparatus according to Embodiment 1 of the present invention. The indoor unit 1 in FIGS. 1 and 2 is a wall-mounted type indoor unit that is provided, for example, on a wall in a room, and includes a case 2, an air-sending fan 3 accommodated in the case 2, and a heat exchanger unit 10 that is accommodated in the case 2 and to which air is sent by the air-sending fan 3.

The case 2 includes a back case 2*a* and a front case 2*b* that are formed from a material such as resin, the back case 2*a* is fixed to a wall or other structure, and the front case 2*b* is attached to the back case 2*a*. In addition, the air-sending fan 3 and the heat exchanger unit 10 are mounted on the back case 2*a*. The back case 2*a* includes, at a position opposed to the air-sending fan 3, an air passage wall 2*w* that forms an air passage through which sucked air flows, and the air passage wall 2*w* has, for example, a tilted shape such as a circular arc shape.

The front case 2*b* has an air inlet 2*x* formed in a top surface of the front case 2*b*, and has an air outlet 2*z* through which conditioned air having exchanged heat in the heat exchanger unit 10 is blown out. A vertical air direction adjusting plate (flap) is pivotally disposed in the air outlet 2*z* and adjusts the direction of the conditioned air blown out through the air outlet 2*z*.

The air-sending fan 3 is composed of, for example, a line flow fan such as a cross flow fan and a through flow fan, and is provided in an air passage from the air inlet 2*x* to the air outlet 2*z* and at the downstream side of the heat exchanger unit 10 and the upstream side of the air outlet. The air-sending fan 3 sucks indoor air through the air inlet 2*x* and blows out conditioned air through the air outlet 2*z*. One end side of the air-sending fan 3 is rotatably supported by the back case 2*a* via a bearing or other component and is connected to a motor.

During cooling operation, the heat exchanger unit 10 serves as an evaporator to cool air. During heating operation, the heat exchanger unit 10 serves as a condenser to heat air. The heat exchanger unit 10 is disposed at the upstream side of the air-sending fan 3 and is shaped to cover the front surface and the upper surface of the air-sending fan 3. The heat exchanger unit 10 includes a first heat exchanger 20 located at a side of the front case 2*b* and at the front side of the air-sending fan 3, and a second heat exchanger 30 located at a side of the back case 2*a* and tilted to the rear side of the air-sending fan 3.

Figure 3:
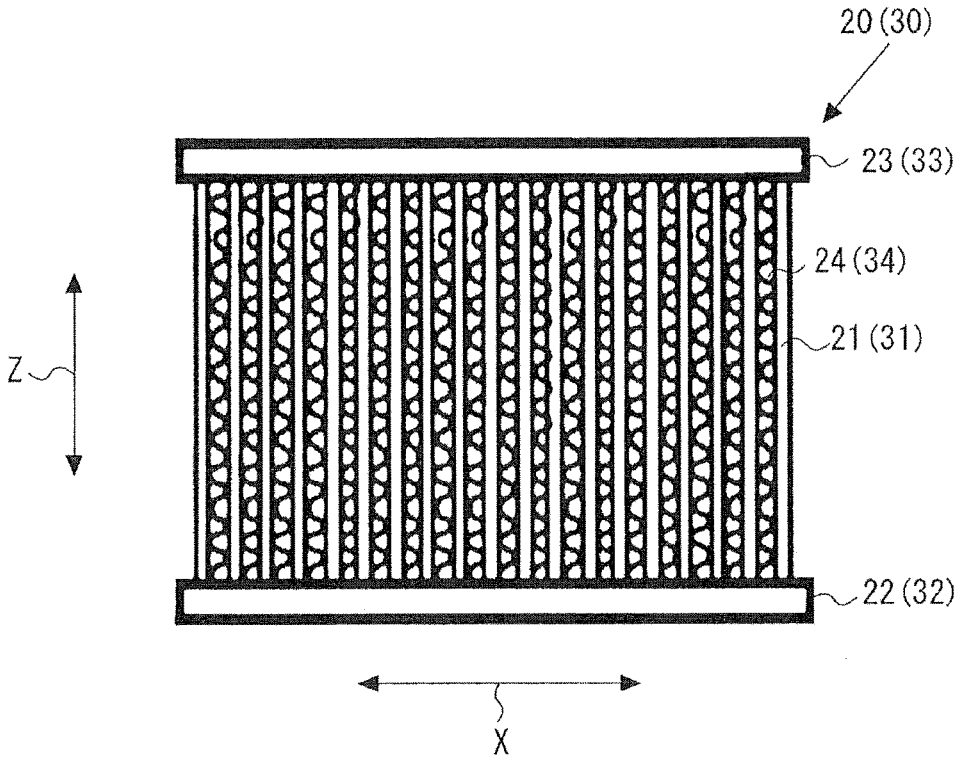
FIG. 3 is a schematic diagram showing an example of a first heat exchanger of the indoor unit for an air-conditioning apparatus in FIG. 2.

FIG. 3 is a schematic diagram showing an example of the first heat exchanger in the indoor unit for an air-conditioning apparatus in FIG. 2. As shown in FIGS. 2 and 3, the first heat exchanger 20 includes a plurality of first heat-transfer pipes 21 arranged in each of a width direction of the case 2 (an arrow X direction) and an air flow direction, a first lower header 22 connected to the lower ends of the plurality of first heat-transfer pipes 21, and a first upper header 23 connected to the upper ends of the plurality of first heat-transfer pipes 21. The first heat-transfer pipes 21 have a structure in which, for example, a plurality of flattened pipes each having a plurality of refrigerant passages in the air flow direction (the thickness direction of the heat exchanger unit 10) are arranged in the width direction of the case 2 (the arrow X direction). Alternatively, the first heat-transfer pipes 21 may be composed of a plurality of pipes each having one refrigerant passage and arranged in the air flow direction.

The plurality of first heat-transfer pipes 21 are arranged to extend in the vertical direction (an arrow Z direction). In particular, the plurality of first heat-transfer pipes 21 are each formed in a curved shape projecting toward the front case 2*b* and have a shape having an increased mount area as compared to the case of a linear shape.

In addition, the first heat exchanger 20 includes first heat transfer fins 24 arranged between the plurality of first heat-transfer pipes 21 arranged in the width direction of the case 2 (the arrow X direction), and the first heat transfer fins 24 exchange heat between air and refrigerant flowing through the first heat-transfer pipes 21.

The second heat exchanger 30 has a structure similar to that of the first heat exchanger 20 shown in FIG. 3, and includes a plurality of second heat-transfer pipes 31 arranged in each of the width direction of the case 2 (the arrow X direction) and the air flow direction, a second lower header 32 connected to the lower ends of the plurality of second heat-transfer pipes 31, and a second upper header 33 connected to the upper ends of the plurality of second heat-transfer pipes 31. The second heat-transfer pipes 31 have a structure in which, for example, a plurality of flattened pipes each having a plurality of refrigerant passages in the air flow direction (the thickness direction of the heat exchanger unit 10) are arranged in the width direction of the case 2 (the arrow X direction). Alternatively, the second heat-transfer pipes 31 may be composed of a plurality of pipes each having one refrigerant passage and arranged in the air flow direction. The second heat-transfer pipes 31 are formed in a linear shape to extend in the vertical direction (the arrow Z direction). In addition, the second heat exchanger 30 includes second heat transfer fins 34 arranged between the plurality of second heat-transfer pipes 31 arranged in the width direction of the case 2 (the arrow X direction), and the second heat transfer fins 34 exchange heat between air and the refrigerant flowing through the second heat-transfer pipes 31.

FIG. 2 shows, as an example, the case where each of the first upper header 23, the first lower header 22, the second upper header 33, and the second lower header 32 has a substantially rectangular cross-sectional shape. However, the shape of each of the first upper header 23, the first lower header 22, the second upper header 33, and the second lower header 32 is not limited to this shape, and each of the first upper header 23, the first lower header 22, the second upper header 33, and the second lower header 32 may be formed, for example, in a circular cross-sectional shape or other shape. In addition, the first heat exchanger 20 and the second heat exchanger 30 are not limited to the case where each of the first heat exchanger 20 and the second heat exchanger 30 has a fin structure as shown in FIG. 3, as long as the first heat exchanger 20 and the second heat exchanger 30 are formed so that the first heat-transfer pipes 21 and the second heat-transfer pipes 31 extend in the vertical direction (the arrow Z direction). In the first heat exchanger 20 and the second heat exchanger 30, for example, the heat-transfer pipes (flattened pipes) may serve as fins and exchange heat between air and the refrigerant flowing through the refrigerant passages.

As described above, a plurality of headers, that is, the first upper header 23, the first lower header 22, the second upper header 33, and the second lower header 32 are provided in the heat exchanger unit 10. Here, each of the first upper header 23 and the first lower header 22 of the first heat exchanger 20 is composed of a plurality of division headers that divide and connect the plurality of first heat-transfer pipes 21 arranged in the air flow direction. Meanwhile, in the second heat exchanger 30, the second upper header 33 is a division header, and the second lower header 32 is a return header that turns back the refrigerant passages in the air flow direction. As described above, in the heat exchanger unit 10, the division header and the return header are provided in at least either one of the first heat exchanger 20 or the second heat exchanger 30.

Specifically, the first lower header 22 of the first heat exchanger 20 includes first lower division headers 22*a* and 22*b* that divide the plurality of first heat-transfer pipes 21 in the thickness direction into different refrigerant passages, and the first upper header 23 of the first heat exchanger 20 includes first upper division headers 23*a* and 23*b* that divide the plurality of refrigerant passages in the air flow direction. The first lower division header 22*a* and the first upper division header 23*a* are connected to one or more refrigerant passages at the front side among the plurality of refrigerant passages arranged in the air flow direction. The first lower division header 22*b* and the first upper division header 23*b* are connected to one or more refrigerant passages at the back side. Consequently, in the first heat exchanger 20, two large refrigerant passages are formed in the air flow direction.

Figure 4:
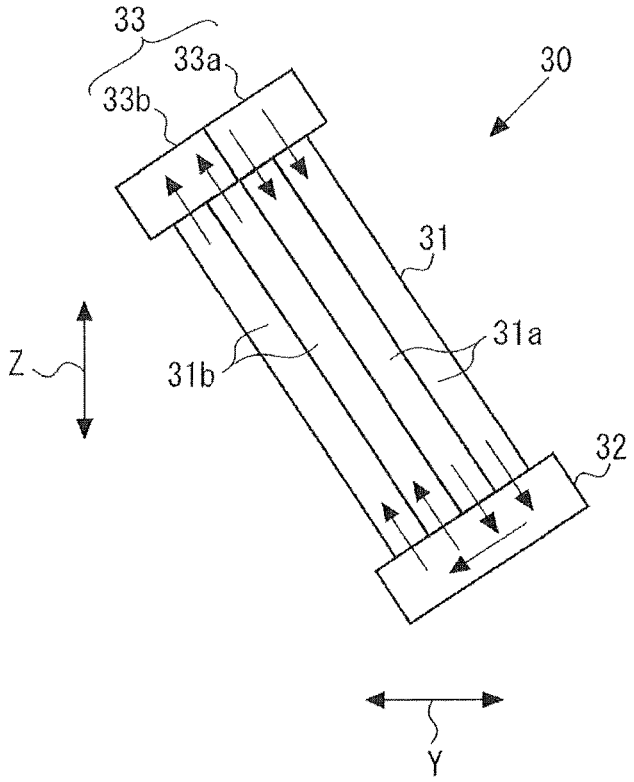
FIG. 4 is a schematic diagram showing an example of a second heat exchanger of the indoor unit for an air-conditioning apparatus in FIG. 2.

FIG. 4 is a schematic diagram showing an example of the second heat exchanger in the indoor unit for an air-conditioning apparatus in FIG. 2. In the second heat exchanger 30 in FIGS. 2 and 4, the second upper header 33 includes second upper division headers 33*a* and 33*b* that divide the plurality of refrigerant passages in the air flow direction. Meanwhile, the second lower header 32 is a return header and forms a refrigerant passage that connects and turns back a plurality of refrigerant passages 31*a* and 31*b* arranged in the air flow direction. The second upper division headers 33*a* and 33*b* are connected to the first upper division headers 23*a* and 23*b* of the first heat exchanger 20, respectively, so that the refrigerant flows continuously between the first heat exchanger 20 and the second heat exchanger 30. At this time, refrigerant passages that cause counterflows are formed in each of the first heat exchanger 20 and the second heat exchanger 30.

For example, the refrigerant flowing in through the first lower division header 22*a* of the first heat exchanger 20 flows through the refrigerant passages at the front side in the first heat-transfer pipes 21 into the first upper division header 23*a*. Subsequently, the refrigerant in the first upper division header 23*a* flows to the second upper header 33 of the second heat exchanger 30, and flows from the second upper header 33 at the back side through the refrigerant passages at the back side in the plurality of second heat-transfer pipes 31 into the second lower header 32. The refrigerant is turned back in the second lower header 32, flows through the refrigerant passages at the front side in the second heat-transfer pipes 31 in the second heat exchanger 30, and flows into the second upper division header 33*b*. The refrigerant in the second upper division header 33*b* flows into the first upper division header 23*b* at the back side (the air-sending fan side), flows through the refrigerant passages at the back side in the first heat-transfer pipes 21 into the first lower division header 22*b*, and flows out from the heat exchanger unit 10.

According to Embodiment 1 described above, the first heat exchanger 20 and the second heat exchanger 30 of the heat exchanger unit 10 are parallel flow type heat exchangers, and thus the refrigerant can be evenly distributed to the plurality of first heat-transfer pipes 21 and second heat-transfer pipes without influence of the gravity. Consequently, a decrease in the heat exchange efficiency caused by the refrigerant unevenly flowing through a partial region of the heat exchanger can be reduced. In this case, as the heat exchanger unit 10 includes the division headers and the return header, a plurality of refrigerant passages that cause counterflows in the refrigerant flow direction are formed. Thus, the heat transfer area can be increased to improve air-conditioning performance. In addition, as the plurality of first heat-transfer pipes 21 are each formed in a curved shape, the mount area in the case 2 increases to improve the air-conditioning performance.

In particular, in the case where, in each of the first heat exchanger 20 and the second heat exchanger 30, a plurality of refrigerant passages that cause counterflows are formed, occurrence of a temperature difference can be inhibited between air passing through an upper portion of the heat exchanger unit 10 and air passing through a lower portion of the heat exchanger unit 10.

Figure 5:
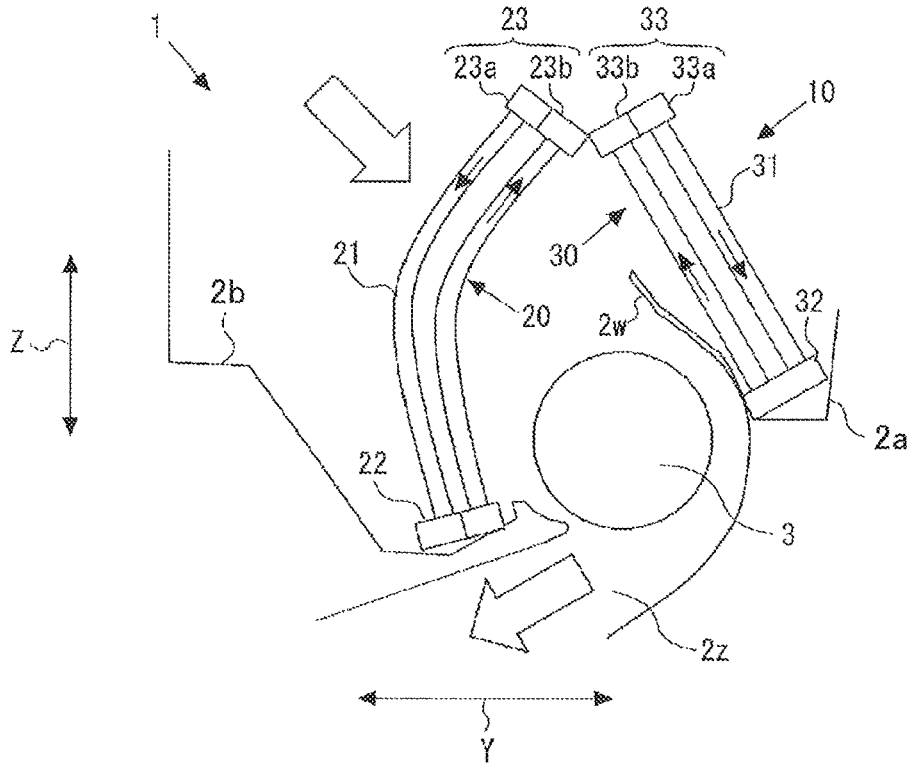
FIG. 5 is a cross-sectional view showing a modification of the indoor unit for an air-conditioning apparatus according to Embodiment 1 of the present invention.

In Embodiment 1 described above, the case is shown where the return header is provided to the second heat exchanger 30 and the refrigerant continuously flows through the first heat exchanger 20 and the second heat exchanger 30. However, the flow of the refrigerant is not limited to this case, and for example, the refrigerant may flow through each of the first heat exchanger 20 and the second heat exchanger 30. FIG. 5 is a cross-sectional view showing a modification of the indoor unit for an air-conditioning apparatus according to Embodiment 1 of the present invention. As shown in FIG. 5, the first lower header 22 of the first heat exchanger 20 may be composed of a return header.

Then, the refrigerant may flow in from each of the first upper header 23 of the first heat exchanger 20 and the second upper header 33 of the second heat exchanger 30, may pass through the first heat-transfer pipes 21 and the second heat-transfer pipes 31, and may flow into the first lower header 22 and the second lower header 32. Subsequently, the refrigerant may be turned back at the first lower header 22 and the second lower header 32, may pass through the first heat-transfer pipes 21 and the second heat-transfer pipes 31, and may flow out from the first upper header 23 and the second upper header 33 to the outdoor unit. In this case as well, as the return header is provided in the heat exchanger unit 10, the heat transfer area can be increased to improve the air-conditioning capacity.

Embodiment 2

Figure 6:
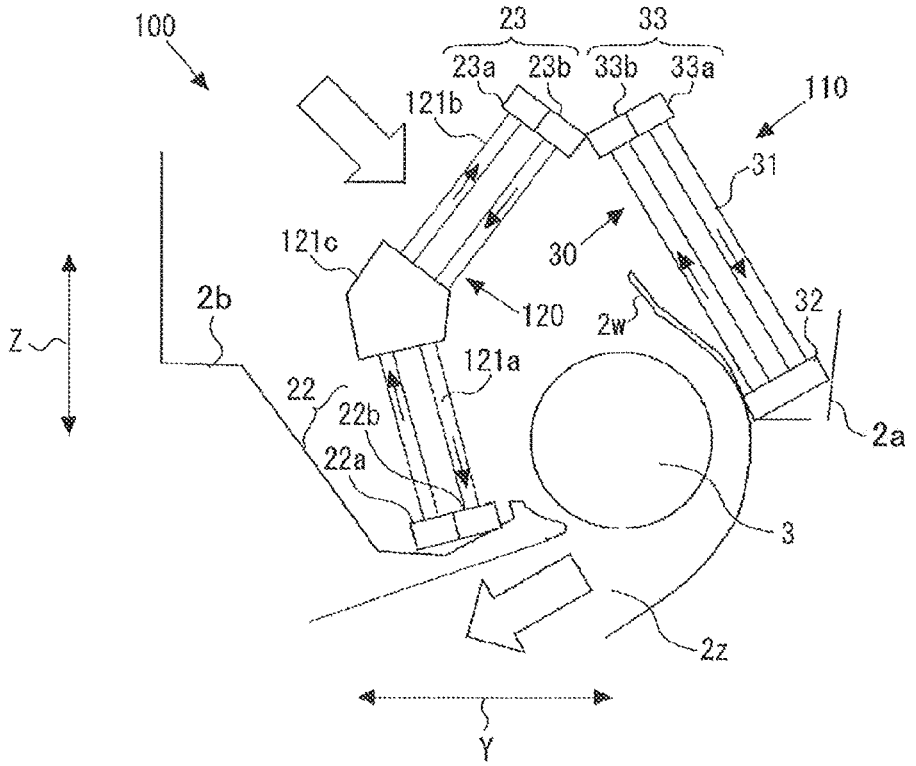
FIG. 6 is a cross-sectional view showing an indoor unit for an air-conditioning apparatus according to Embodiment 2 of the present invention.

FIG. 6 is a cross-sectional view showing an indoor unit for an air-conditioning apparatus according to Embodiment 2 of the present invention. An indoor unit 100 for an air-conditioning apparatus is described with reference to FIG. 6. In the indoor unit 100 for an air-conditioning apparatus in FIG. 6, portions having the same configuration as in the indoor unit 1 for an air-conditioning apparatus in FIG. 2 are designated by the same reference signs, and the description of the potions is omitted. The indoor unit 100 for an air-conditioning apparatus in FIG. 6 is different from the indoor unit for an air-conditioning apparatus in FIG. 2 in the configuration of a first heat exchanger 120.

The first heat exchanger 120 in FIG. 6 includes, in addition to the first lower header 22 and the first upper header 23, lower heat-transfer pipes 121*a* connected to the first lower header 22, upper heat-transfer pipes 121*b* connected to the first upper header 23, and an intermediate header 121*c* connecting the upper ends of the lower heat-transfer pipes 121*a* to the lower ends of the upper heat-transfer pipes 121*b*. The lower heat-transfer pipes 121*a* and the upper heat-transfer pipes 121*b* are each formed in a linear shape, and are connected to each other at the intermediate header 121*c* to bend. In the intermediate header 121*c*, among the lower heat-transfer pipes 121*a* and the upper heat-transfer pipes 121*b*, the lower heat-transfer pipe 121*a* and the upper heat-transfer pipe 121*b* at the side of the front case 2*b*, and the lower heat-transfer pipe 121*a* and the upper heat-transfer pipe 121*b* at the side of the back case 2*a* are partitioned off to form different refrigerant passages that are the same as the refrigerant passages in FIG. 2 described above.

According to Embodiment 2, as the lower heat-transfer pipes 121*a* and the upper heat-transfer pipes 121*b* each formed in a linear shape are included and are connected to each other at the intermediate header 121*c* to bend, the mount area of the first heat exchanger 120 can be increased to improve air-conditioning performance, similarly as in the case of a curved surface shape as in Embodiment 1. In addition, as a return header is provided to the second heat exchanger 30 also in Embodiment 2, the air-conditioning performance can be improved.

Even in the case of the first heat exchanger 120 in FIG. 6, the first lower header 22 may be composed of a return header as shown in FIG. 5. Furthermore, the refrigerant may flow from the intermediate header 121*c* into the outdoor unit and from the outdoor unit into the intermediate header 121*c*. In this case, the intermediate header 121*c* may be structured so that the refrigerant is distributed to the lower heat-transfer pipes 121*a* and the upper heat-transfer pipes 121*b*, and the first lower header 22 may be composed of a return header.

Embodiment 3

Figure 7:
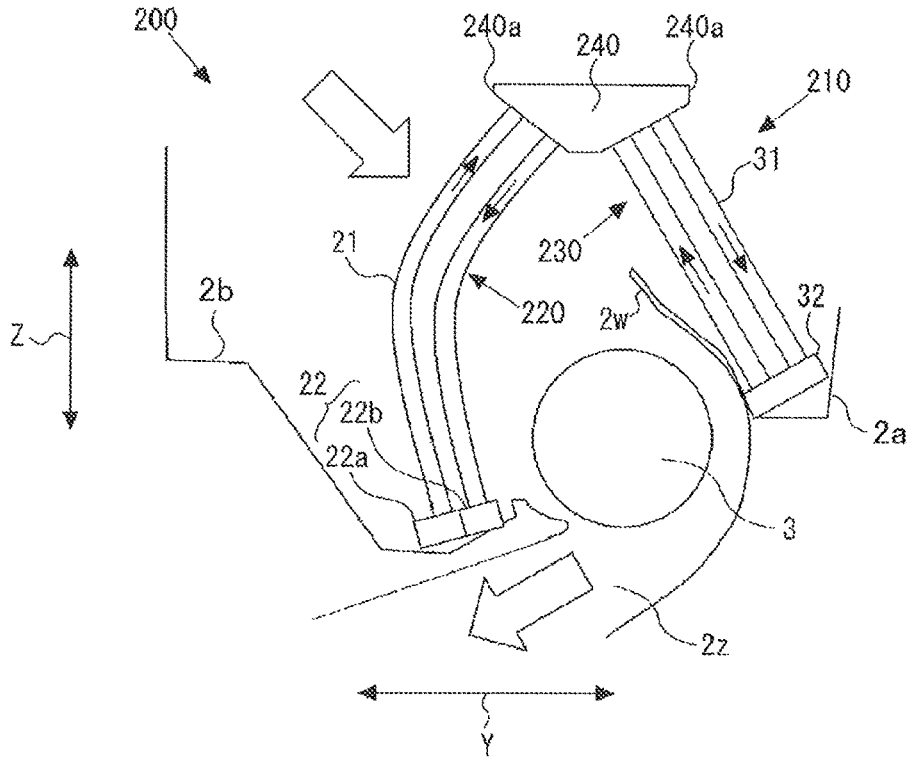
FIG. 7 is a cross-sectional view showing an indoor unit for an air-conditioning apparatus according to Embodiment 3 of the present invention.

FIG. 7 is a cross-sectional view of an indoor unit for an air-conditioning apparatus according to Embodiment 3 of the present invention. An indoor unit 200 for an air-conditioning apparatus is described with reference to FIG. 7. In the indoor unit 200 for an air-conditioning apparatus in FIG. 7, portions having the same configuration as in the indoor unit 1 for an air-conditioning apparatus in FIG. 2 are designated by the same reference signs, and the description of the portions is omitted. The indoor unit 200 for an air-conditioning apparatus in FIG. 7 is different from the indoor unit for an air-conditioning apparatus in FIG. 2 in that a first upper header of a first heat exchanger 220 and a second upper header of a second heat exchanger 230 are integrally formed as a connection header 240.

The connection header 240 has, for example, a substantially triangular cross-sectional shape, and, in the connection header 240, for example, a first heat-transfer pipe 21 at the front side of the first heat exchanger 220 and a second heat-transfer pipe 31 at the back side of the second heat exchanger 230 are connected to each other to form a refrigerant passage that is the same as in FIG. 2. In particular, cutout portions 240*a* for reducing air resistance are formed at corners of the connection header 240.

According to Embodiment 3, as the first upper header of the first heat exchanger 220 and the second upper header of the second heat exchanger 230 are integrally formed as the connection header 240, the number of components can be reduced to simplify the structure of a heat exchanger unit 210. In addition, also in Embodiment 2, a return header is provided to the second heat exchanger 30, and thus the air-conditioning performance can be improved. Even in the case as in Embodiment 3, a refrigerant passage may be formed as shown in FIG. 5 so that the refrigerant flows in through the connection header 240.

Embodiments of the present invention are not limited to the embodiments described above. For example, the case is shown where the heat exchanger unit 10, 110, or 210 includes two heat exchangers, that is, the first heat exchanger 20, 120, or 220 and the second heat exchanger 30 or 230 in each of Embodiments 1 to 3 described above; however, the heat exchanger unit 10, 110, or 210 may include three or more heat exchangers. In this case as well, refrigerant distributing characteristics can be improved by disposing heat-transfer pipes to extend in the vertical direction and by disposing a distributing header to extend in the horizontal direction.

The case is shown where two refrigerant passages are formed in the air flow direction in each of the first heat exchanger 20, 120, or 220 and the second heat exchanger 30 or 230 in each of Embodiments 1 to 3 described above; however, three or more refrigerant passages may be formed. Furthermore, the case is shown where the refrigerant flows in the first heat exchanger 20, 120, or 220 and the second heat exchanger 30 or 230 in the same direction in the width direction (arrow X direction); however, the header may be divided so that the refrigerant flows in different directions at the upper and lower sides also in the width direction (arrow Y direction). In addition, the wall-mounted type indoor unit is shown in each of Embodiments 1 to 3 described above; however, the present invention can also apply to a ceiling-embedded type indoor unit.

Figure 8:
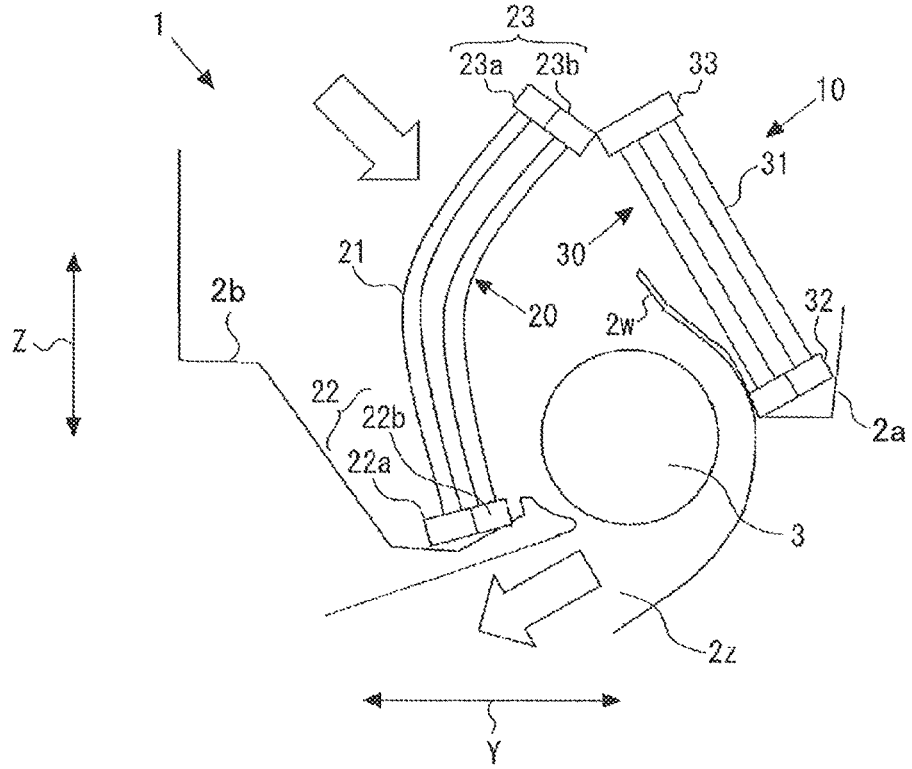
FIG. 8 is a cross-sectional view showing a modification of the indoor unit for an air-conditioning apparatus of the present invention.

Furthermore, the case is shown where the second lower header 32 is a return header and the second upper header 33 is composed of division headers in the second heat exchanger 30 of each of Embodiments 1 and 2 described above; however, the second upper header 33 may be a return header, and the second lower header 32 may be composed of division headers. FIG. 8 is a cross-sectional view showing a modification of the indoor unit for an air-conditioning apparatus of the present invention. Portions having the same configuration as in the indoor unit for an air-conditioning apparatus in FIG. 1 are designated by the same reference signs, and the description of the portions is omitted. Even in this case, the first heat exchanger 20 and the second heat exchanger 30 are connected so that the second lower header 32 is connected to the first upper header 23 or the first lower header 22 to form a continuous refrigerant passage. In addition, the intermediate header 121*c* shown in Embodiment 2 may be used in the first heat exchanger 20.

During cooling operation of the indoor unit 1 shown in FIG. 8, the quality (dryness) approaches one (gas phase) as the refrigerant exchanges heat in the second heat exchanger 30. Then, when the refrigerant is dried in the middle of the second heat exchanger 30, dew water may occur. At this time, in the case where the second upper header 33 is a return header as described above, the location where the refrigerant is dried is inside the air passage wall 2*w*. Thus, dew water can be prevented from occurring from the second heat exchanger 30 into the air passage.

REFERENCE SIGNS LIST

1, 100, 200 indoor unit for an air-conditioning apparatus 2 case 2*a* back case 2*b* front case 2*w* air passage wall 2*x* air inlet 2*z* air outlet 3 air-sending fan 10, 110, 210 heat exchanger unit 20, 120, 220 first heat exchanger 21 first heat-transfer pipe 22 first lower header 22*a*, 22*b* first lower division header 23 first upper header 23*a*, 23*b* first upper division header 24 first heat transfer fin 30, 230 second heat exchanger 31 second heat-transfer pipe 31*a*, 31*b* refrigerant passage 32 second lower header (return header) 33 second upper header 33*a*, 33*b* second upper division header 34 second heat transfer fin 121*a* lower heat-transfer pipe 121*b* upper heat-transfer pipe 121*c* intermediate header 240 connection header 240*a* cutout portion

The invention claimed is:

1. An indoor unit for an air-conditioning apparatus comprising a case including a front case and a back case, an air-sending fan accommodated in the case, and a heat exchanger unit provided to cover the air-sending fan and configured to exchange heat between refrigerant and air, the heat exchanger unit including a plurality of heat-transfer pipes extending in a vertical direction and forming a plurality of refrigerant passages in an air flow direction and a width direction of the case, and a plurality of headers connected to both ends of the plurality of heat-transfer pipes to allow the refrigerant to flow between the plurality of heat-transfer pipes, the plurality of headers including a plurality of division headers dividing and connecting the plurality of refrigerant passages arranged in the air flow direction and connecting in parallel the plurality of refrigerant passages arranged in the width direction of the case, and a return header connecting and turning back the plurality of refrigerant passages arranged in the air flow direction divided in the plurality of division headers and connecting in parallel the plurality of heat-transfer pipes arranged in the width direction of the case, the heat exchanger unit including a first heat exchanger disposed at a side of the front case and including first heat-transfer pipes arranged in the width direction of the case and the air flow direction, and a second heat exchanger disposed at a side of the back case and including second heat-transfer pipes arranged in the width direction of the case and the air flow direction, at least either one of the first heat exchanger or the second heat exchanger including the return header, the first heat exchanger and the second heat exchanger being connected to form a continuous refrigerant passage, in each of the first heat exchanger and the second heat exchanger, the plurality of refrigerant passages causing counterflows.

2. The indoor unit for an air-conditioning apparatus of claim 1, wherein the first heat exchanger includes a first lower header constituted of the plurality of division headers connected to lower ends of the first heat-transfer pipes, and a first upper header constituted of the plurality of division headers connected to upper ends of the first heat-transfer pipes, the second heat exchanger includes a second lower header constituted of the return header connected to lower ends of the second heat-transfer pipes, and a second upper header constituted of the plurality of division headers connected to the first upper header and upper ends of the second heat-transfer pipes, and in the first heat exchanger and the second heat exchanger, a refrigerant passage through which the refrigerant flows from the first upper header into the second upper header and a refrigerant passage through which the refrigerant flows from the second upper header into the first upper header are formed.

3. The indoor unit for an air-conditioning apparatus of claim 2, wherein the first upper header of the first heat exchanger and the second upper header of the second heat exchanger are integrally formed as a connection header.

4. The indoor unit for an air-conditioning apparatus of claim 1, wherein the first heat exchanger includes a first lower header constituted of the plurality of division headers connected to lower ends of the first heat-transfer pipes, and a first upper header constituted of the plurality of division headers connected to upper ends of the first heat-transfer pipes, the second heat exchanger includes a second lower header constituted of the plurality of division headers connected to either one of the first lower header or the first upper header and lower ends of the second heat-transfer pipes, and a second upper header constituted of the return header connected to upper ends of the second heat-transfer pipes, and in the first heat exchanger and the second heat exchanger, a refrigerant passage through which the refrigerant flows from either one of the first lower header or the first upper header into the second upper header and a refrigerant passage through which the refrigerant flows from the second heat exchanger into either one of the first lower header or the first upper header are formed.

5. The indoor unit for an air-conditioning apparatus of claim 1, wherein the plurality of the first heat-transfer pipes are each formed in a curved shape projecting toward the front case.

6. The indoor unit for an air-conditioning apparatus of claim 2, wherein the first heat-transfer pipes include a lower heat-transfer pipe connected to the first lower header and formed in a linear shape, and an upper heat-transfer pipe connected to the first upper header and formed in a linear shape, the first heat exchanger includes an intermediate header connecting the lower heat-transfer pipe and the upper heat-transfer pipe, and the lower heat-transfer pipe and the upper heat-transfer pipe are connected to each other at the intermediate header to bend in a shape projecting toward the front case.

* * * * *